US007931189B2

(12) United States Patent
Kalenburg

(10) Patent No.: US 7,931,189 B2
(45) Date of Patent: Apr. 26, 2011

(54) KIT AND METHOD TO PROVIDE MAIL SECURITY FOR A MAILBOX

(76) Inventor: Harry Kalenburg, Plano, TX (US)

( * ) Notice: Subject to any disclaimer, the term of this patent is extended or adjusted under 35 U.S.C. 154(b) by 0 days.

(21) Appl. No.: 12/579,160

(22) Filed: Oct. 14, 2009

(65) Prior Publication Data

US 2010/0096442 A1 Apr. 22, 2010

Related U.S. Application Data

(60) Provisional application No. 61/135,888, filed on Oct. 17, 2008, provisional application No. 61/215,161, filed on May 4, 2009.

(51) Int. Cl.
*B65G 11/04* (2006.01)

(52) U.S. Cl. ..... 232/45; 232/17; 232/38; 70/63; 109/66

(58) Field of Classification Search ..... 232/17, 232/44, 45, 29, 33, 38, 24; 49/68; 70/63, 70/160–162; 109/66–68; 220/826
See application file for complete search history.

(56) References Cited

U.S. PATENT DOCUMENTS

| | | | | |
|---|---|---|---|---|
| 380,148 | A * | 3/1888 | Thompson | 232/29 |
| 755,038 | A * | 3/1904 | Palmer | 232/24 |
| 2,945,621 | A * | 7/1960 | Kopprasch et al. | 232/24 |
| 4,181,250 | A | 1/1980 | Withrow | |
| 4,333,603 | A | 6/1982 | Carlson | |
| 4,361,271 | A | 11/1982 | Hester et al. | |
| 4,726,512 | A | 2/1988 | White | |
| 4,753,386 | A | 6/1988 | Phillion, Sr. | |
| 5,407,126 | A | 4/1995 | Coultas et al. | |
| 5,645,215 | A | 7/1997 | Marendt et al. | |
| 5,765,749 | A | 6/1998 | Harper | |
| 5,915,618 | A | 6/1999 | Gaudet | |
| 5,921,117 | A | 7/1999 | Illguth | |
| 6,520,405 | B1 | 2/2003 | Braxter | |
| 6,808,108 | B1 * | 10/2004 | Turnbow et al. | 232/29 |
| 7,070,090 | B2 | 7/2006 | Ranen | |
| 7,100,816 | B2 * | 9/2006 | Offenbacher | 232/45 |
| 2003/0213837 | A1 | 11/2003 | Morgan | |

FOREIGN PATENT DOCUMENTS

WO WO 2007/139904 A2 12/2007

OTHER PUBLICATIONS

Nguyen, K., "Plano Man Develops Unique Mail Theft Deterrent," Plano Courier Star, Oct. 8, 2009, pp. 1 and 2a, vol. 120, No. 235, Plano Tx.

* cited by examiner

*Primary Examiner* — William L. Miller
(74) *Attorney, Agent, or Firm* — Slater & Matsil, L.L.P.

(57) ABSTRACT

A retrofit mailbox security kit includes a binding strap conformable to an interior surface of a mailbox and a hingeably attached security door. A security tab is rigidly attached to the binding strap. The security door in the closed position and the security tab form a mail insertion aperture extending substantially a width of the mailbox. A lock assembly coupled to the security door can restrain the security door in a closed position. The binding strap may be adhered to the interior surface of the mailbox with rivets or with two-sided adhesive tape. The two-sided adhesive tape may be covered with a removably adhered protective film accessible through a clearance aperture in the binding strap to enable the binding strap to be rigidly attached to the interior surface of the mailbox.

18 Claims, 6 Drawing Sheets

KIT AND METHOD TO PROVIDE MAIL SECURITY FOR A MAILBOX

This application claims the benefit of U.S. Provisional Application No. 61/135,888, filed on Oct. 17, 2008, entitled "Locking Mailbox Insert That Keeps Your Mail behind Locked Door," and U.S. Provisional Application No. 61/215,161, filed on May 4, 2009, entitled "Locking Mailbox Insert That Keeps Your Mail Safe from Theft," which applications are hereby incorporated herein by reference.

TECHNICAL FIELD

Embodiments of the invention relate generally to security and, in particular examples, to a kit and method to provide mail security for a mailbox.

BACKGROUND

Mailboxes, particularly those designed for outdoor application, provide easy access for a mail carrier to deposit a mail delivery. However, easy mail carrier access also generally provides easy access for a person intent on improperly removing or examining the contents of an exposed mailbox. In view of the frequent use of mail service to deliver items of inherent value, such as checks, financial account summaries, and credit card information, there is a growing need to provide a lockable arrangement to provide access protection for mail in a mailbox positioned in an exposed or otherwise unprotected location. In the vast majority of mailboxes installed in exposed locations, no such lockable arrangement is generally provided in the design.

Several techniques are known to provide a locking mechanism for a mailbox. Examples of such techniques are provided by H. Ranen in U.S. Pat. No. 7,070,090 entitled "Kit and Method for Field-Modification of a Mailbox to Protect against Mail Theft;" J. L. Hester, et al., in U.S. Pat. No. 4,361,271 entitled "Mail Box Conversion Kit," and R. A. Carlson in U.S. Pat. No. 4,333,603 entitled "Mailbox with Lockable Letter Mail Compartment for Use in Motorized Delivery Routes."

SUMMARY OF THE INVENTION

In accordance with an exemplary embodiment, a mailbox security kit and a related method are provided. In an embodiment, the mailbox security kit includes a binding strap that is conformable to an interior surface of a mailbox. A security door is hingeably attached to an inner surface of the binding strap, and a security tab is rigidly attached to the inner surface of the binding strap. A lock assembly is coupled to the security door so that the lock assembly in a locked position restrains the security door in a closed position. A mail insertion aperture between the security door and the security tab when the security door is in the closed position is thereby created.

In a further embodiment, a mailbox includes a mailbox housing and a security door hingeably attached to a first interior side surface of the mailbox housing. In an embodiment, the security door has a main face perpendicular to the interior side surface of the mailbox housing such that the security door swings out of the mailbox housing in an open position. A lock assembly is coupled to the security door, and a lock strike is attached to a second interior side surface of the mailbox housing. The lock strike in conjunction with the lock assembly is configured to restrain the security door in a closed position. A security tab is rigidly attached to an interior top surface of the mailbox housing, and the security tab is spaced from the security door by a slot to form a mail insertion aperture when the security door is in the closed position. The slot has a width that is substantially the same as the width of the mailbox housing and a length of between about one and two inches.

BRIEF DESCRIPTION OF THE DRAWINGS

For a more complete understanding of the present invention, and the advantages thereof, reference is now made to the following descriptions taken in conjunction with the accompanying drawing, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to exemplary embodiments in a specific context, namely a process and method to provide a retrofit arrangement to limit unauthorized access to delivered mail. Concepts of the invention can also be applied in other situations, such as other enclosures that can be secured.

A conventional mailbox designed for outdoor residential use is generally formed of sheet-metal construction with vertical sides and an arched upper surface roughly in the form of a portion of a cylinder. A conventional mailbox may also be formed with a planar upper surface. A front hinged door with a pliable closure mechanism provides easy access for a mail carrier to insert mail. Such mailboxes are frequently referred to as "rural mailboxes" even though they are also employed in urban and suburban environments.

While illustrated with respect a rural mailbox, it is understood that further mailbox security arrangements can be constructed and applied using processes introduced herein in different contexts using inventive concepts described herein, for example, for a mailbox of a different shape or of different construction.

A recognized size for one exemplary mailbox is a size "1," which has a nominal width of about 6.5 inches. Larger recognized sizes are size "1A" and size "2" which have nominal widths of about 8 inches and 11.5 inches, respectively. Any other size mailbox, or other enclosure, can also utilize concepts as discussed herein.

Figure 1:
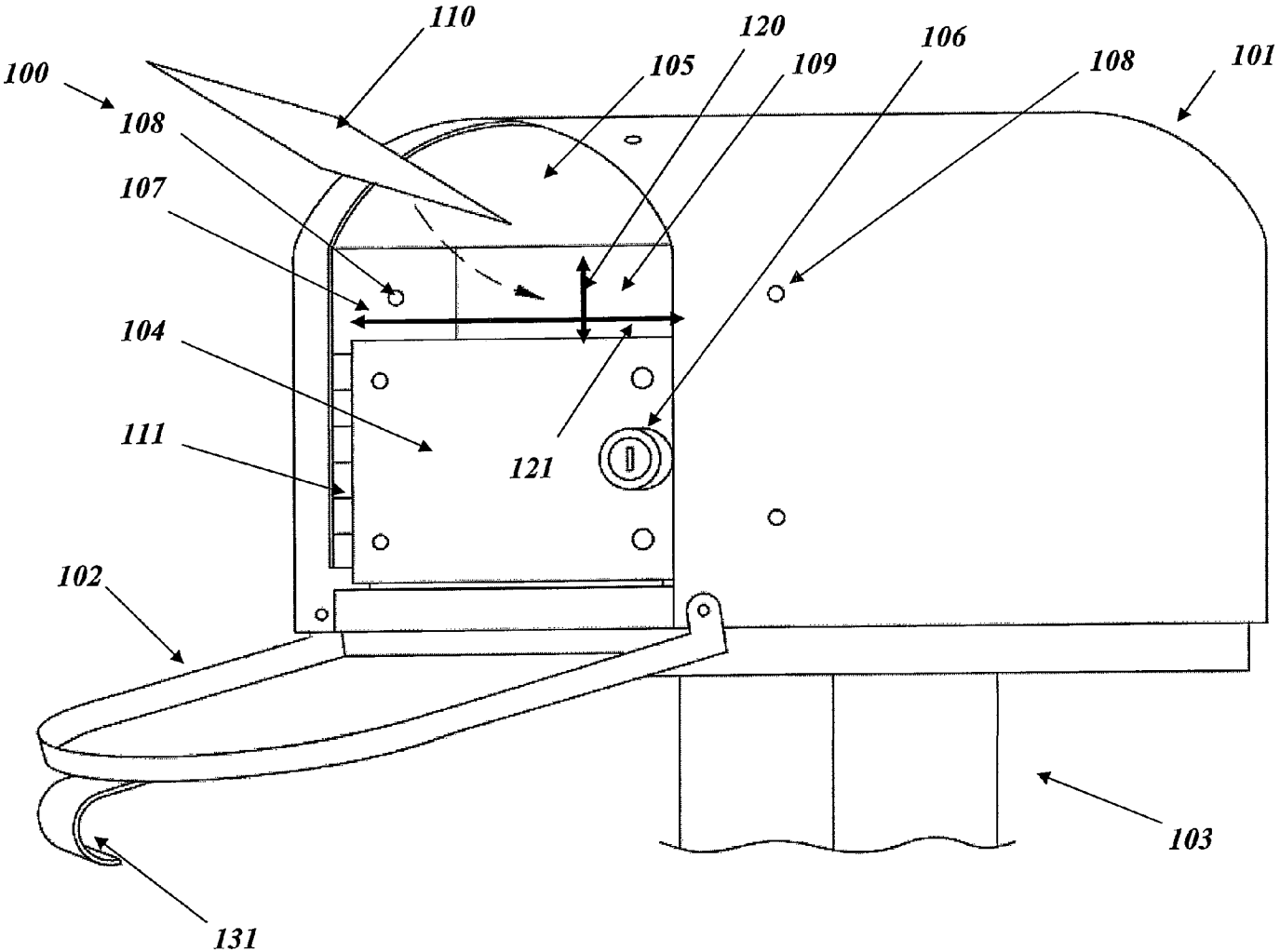
FIG. 1 illustrates a perspective drawing of an exemplary mailbox with a retrofit mailbox security arrangement, constructed according to an embodiment.

FIG. 1 provides a perspective drawing of an exemplary mailbox 100, which includes a mailbox housing 101 and a front hinged door 102 restrainable by a pliable closure mechanism 131. The mailbox 101 is mounted on a post or pole 103. In a typical embodiment, the mailbox 100 is a conventional mailbox such as can be found at any hardware store. In fact, as will be discussed below, one advantageous embodiment provides a retrofit kit that can be used in any of the many thousands of mailboxes in use.

The mailbox 100 includes a mailbox security kit that includes a binding strap 107 that is conformable with and rigidly adhered to an interior surface of the mailbox housing 101. As illustrated in FIG. 1, the binding strap 107 is attached to the interior surface of the mailbox housing 101 with rivets 108, such as "pop" rivets. In other embodiments, the binding strap may be attached by other means. For example, glue, two sided-tape or other fasteners can be used. Suitable adhesives include, without limitation, Gorilla glue and an epoxy adhesive. Also, two or more of these attachment methods can be combined, e.g., glued and riveted.

A security door 104 is attached to an inner surface of the binding strap 107 with a hinge 111 such as a piano hinge. A security tab 105 is rigidly attached to the inner surface of the binding strap so that a mail insertion aperture 109 is formed between the security tab 105 and the security door 104 when the security door is in a closed position. The security door is restrained in the closed position by a locking mechanism that includes a lock assembly 106 and a lock strike (not shown). An exemplary vertical dimension of the security door 104 is 4 inches, and an exemplary vertical dimension of the security tab is 2 inches.

The mail insertion aperture 109 extends the width 121 of the mailbox reduced on the left side and the right side by the thickness of the binding strap and the attachment, if any. In other words, the mail insertion aperture 109 extends substantially the entire width 121 of the mailbox. A piece of deliverable mail 110 can be easily inserted into the mailbox by a mail carrier without obstruction and without the need for folding the mail. The mail insertion aperture 109 is dimensioned in the vertical direction so that a person's hand cannot readily retrieve mail from the mailbox when the security door is in the closed position. Accordingly, the open height 120 of the mail insertion aperture when the security door is in the closed position is preferably in a range of about one inch to two inches.

Figure 2:
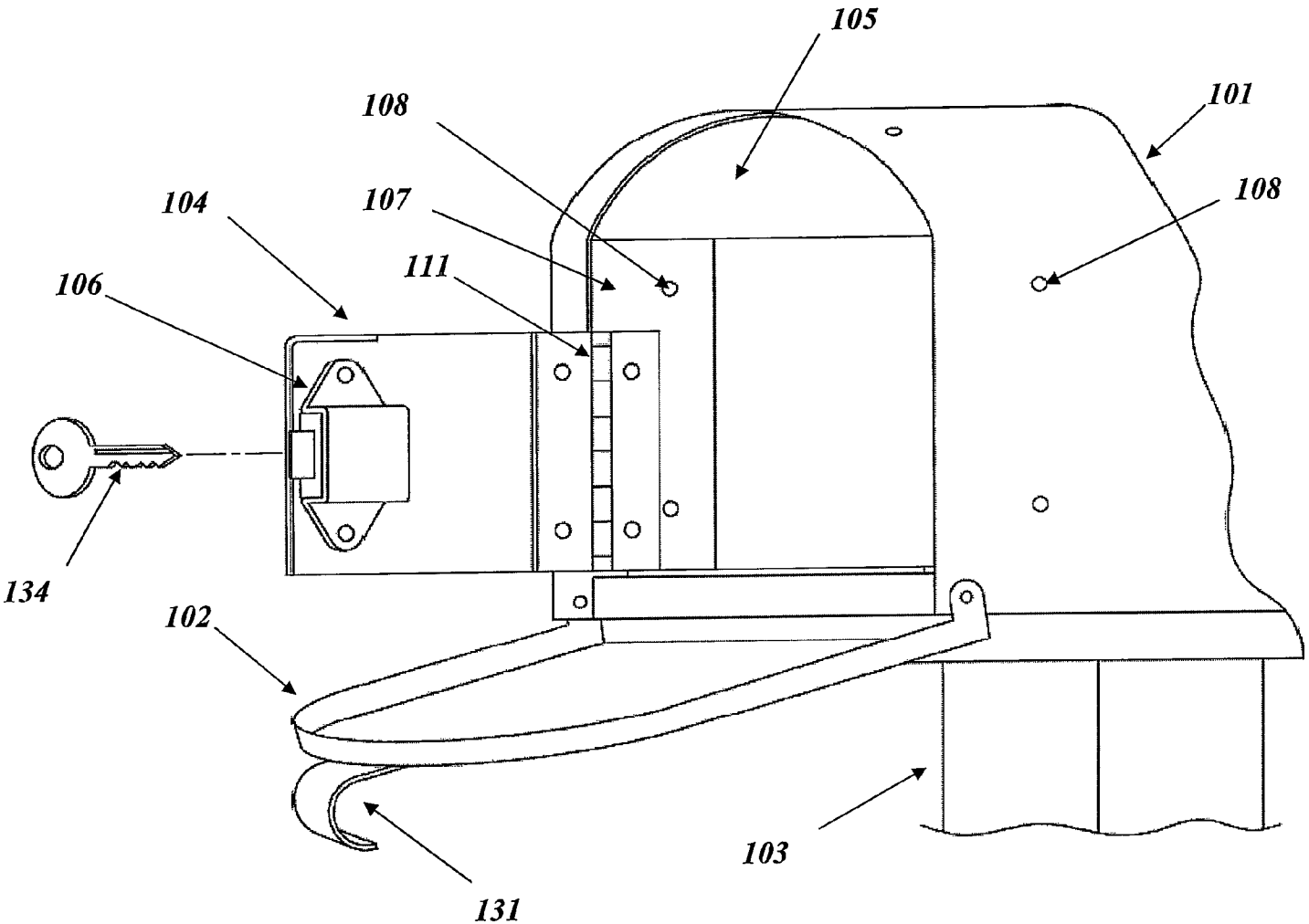
FIG. 2 illustrates a perspective drawing of the mailbox illustrated in FIG. 1 when the security door is in an open position.

FIG. 2 provides a perspective drawing of the mailbox 100 illustrated in FIG. 1 when the security door 104 is in an open position, enabling a person with a key to retrieve mail from the mailbox. The lock assembly 106 is illustrated riveted to the back side of security door 107. Key 134 may be inserted into lock assembly 106 through an aperture formed in the security door 104.

Thus, the mailbox 100 includes a security door 104 hingeably attached to a first interior side surface of the mailbox housing 101. The security door 104 has a main face perpendicular to the interior side surface of the mailbox such that the security door swings out of the mailbox in an open position. A lock assembly 106 is coupled to the security door 104, and a lock strike (not shown in FIG. 2; see element 136 in FIG. 3) is attached to a second interior side surface of the mailbox housing 101. The lock strike 136 in conjunction with the lock assembly 106 is able to restrain the security door 104 in a closed position. The security tab 105 is rigidly attached to an interior top surface of the mailbox housing 101 and is spaced from the security door 104 by a slot to form the mail insertion aperture 109 when the security door 104 is in the closed position. The slot accordingly has a width that is substantially the same as the width of the mailbox housing 101 and a length of between about one and two inches.

Figure 3:
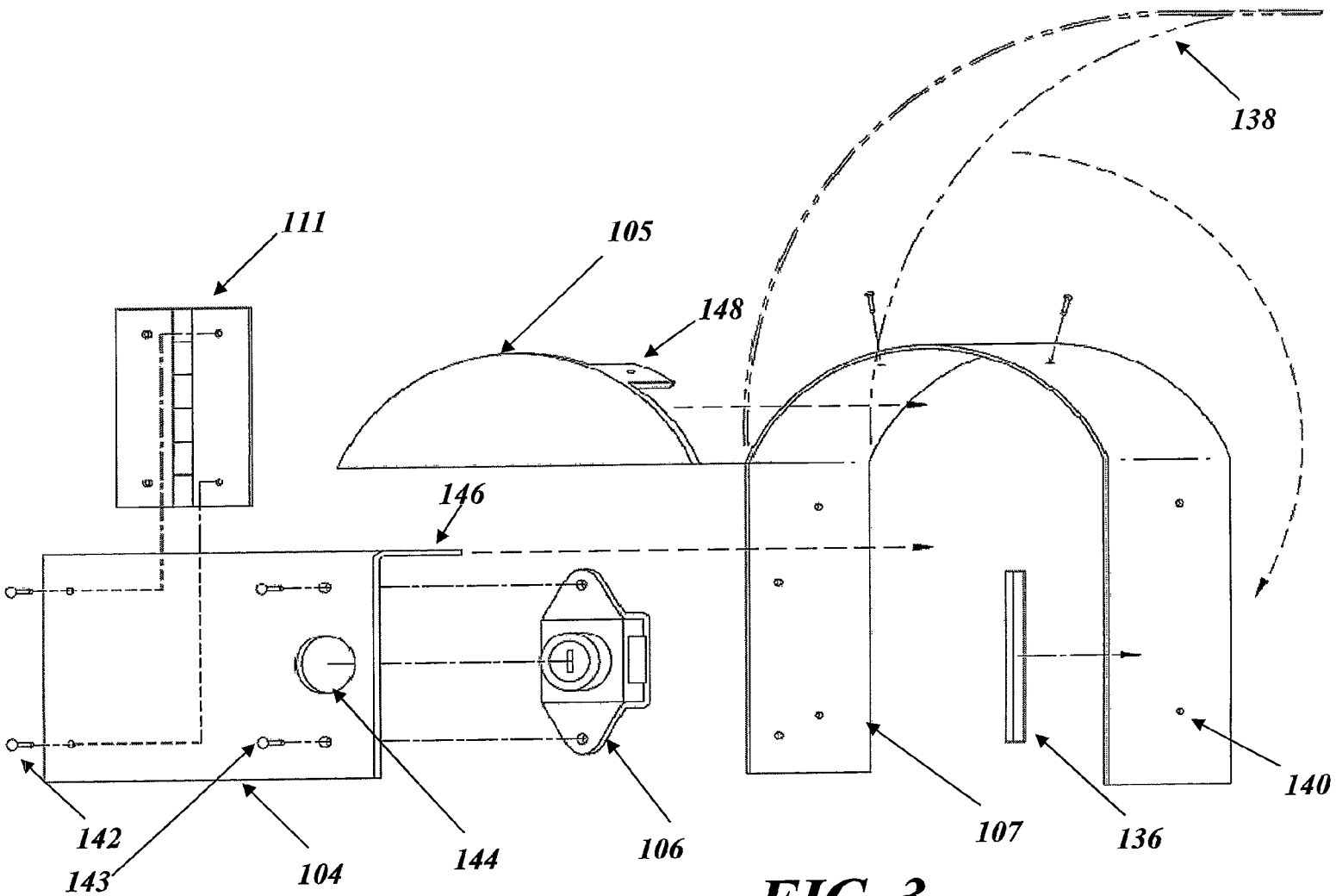
FIG. 3 illustrates a perspective assembly drawing for a mailbox security kit, constructed according to an embodiment.

Turning now to FIG. 3 a perspective assembly drawing for the mailbox security kit is provided. The binding strap 107 is illustrated as a shape conformable to the interior surface of the mailbox. The binding strap 107 is also illustrated in a relaxed position 138, which is a shape it may assume when not constrained by the interior surface of the mailbox. Holes, such as hole 140, are drilled or punched through the binding strap 107 to accommodate rivets or threaded fasteners to secure the binding strap to the interior surface of the mailbox. Hinge 111 is secured to security door 104 by rivets or threaded fasteners, such as rivet 142. Alternative means to secure the binding strap 107 to the interior surface the mailbox housing 101 include an adhesive and two-sided adhesive tape as described later hereinbelow.

Lock strike 136 is secured to the binding strap 107 to enable the locking mechanism 106 to restrain the security door in the closed position. The lock strike 136 may be secured to the binding strap 107 by an adhesive such as an epoxy adhesive. A portion of the locking mechanism 106 extends through an aperture 144 in the security door 104 to enable the locking mechanism to be conveniently unlocked by a key (e.g., key 134 in FIG. 2). The locking mechanism 106 may be secured to the security door 104 by rivets or threaded fasteners, such as rivet 143, or by other mechanical means such as by an adhesive.

The security door 104 can be formed with an extended horizontal surface 146 on a top edge thereof to provide an obstruction for a person's hand to retrieve mail from the mailbox when the security door 104 is in a closed position. The extended horizontal portion 146 may extend, for example, between about one inch and two inches into the mailbox housing 101 when the security door 104 is in the closed position. In other embodiments, the horizontal portion 146 can be longer, shorter or left out altogether.

The security tab 105 is illustrated in FIG. 3 with mounting tabs, such as mounting tab 148 formed on the right side of the security tab 105, to enable the security tab to be rigidly coupled to the inner surface of the binding strap. Another mounting tab (not shown) is formed on the left side of the security tab 105.

The security door 104, lock strike 136, and security tab 105 may be formed, without limitation, of sheet metal, such as aluminum or galvanized steel, or of a plastic material such as chlorinated polyvinyl chloride of a suitable thickness, such as about 0.125 inch or thicker. The binding strap 107 may also be formed, without limitation, of sheet metal, such as aluminum or galvanized steel, or of a plastic material such as chlorinated polyvinyl chloride of a suitable thickness, such as about 0.0625 inch or thicker. An exemplary length of the lock strike 136 is 3.5 inches. These mailbox security kit components may be formed by a cutting, punching, molding or other suitable forming operation.

Figure 4A:
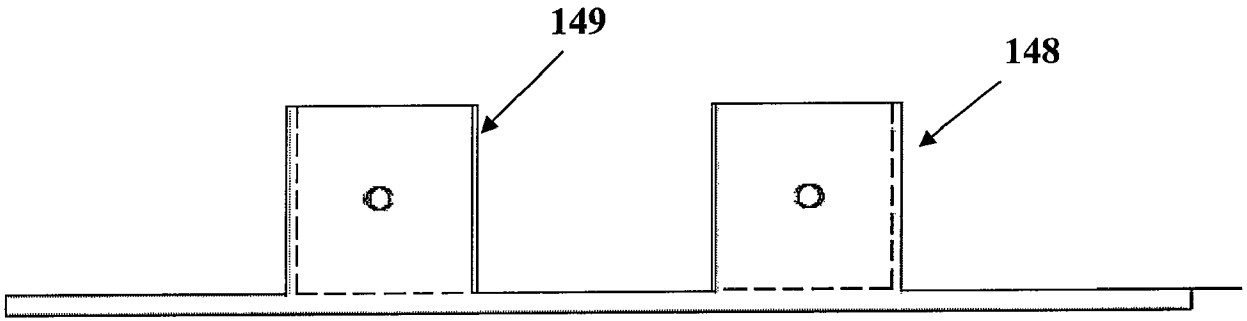
FIG. 4*a* illustrates a top elevation drawing, FIG. 4*b* a front elevation drawing, and FIG. 4*c* a side elevation drawing of a mailbox security tab, constructed according to an embodiment.
Figure 4B:
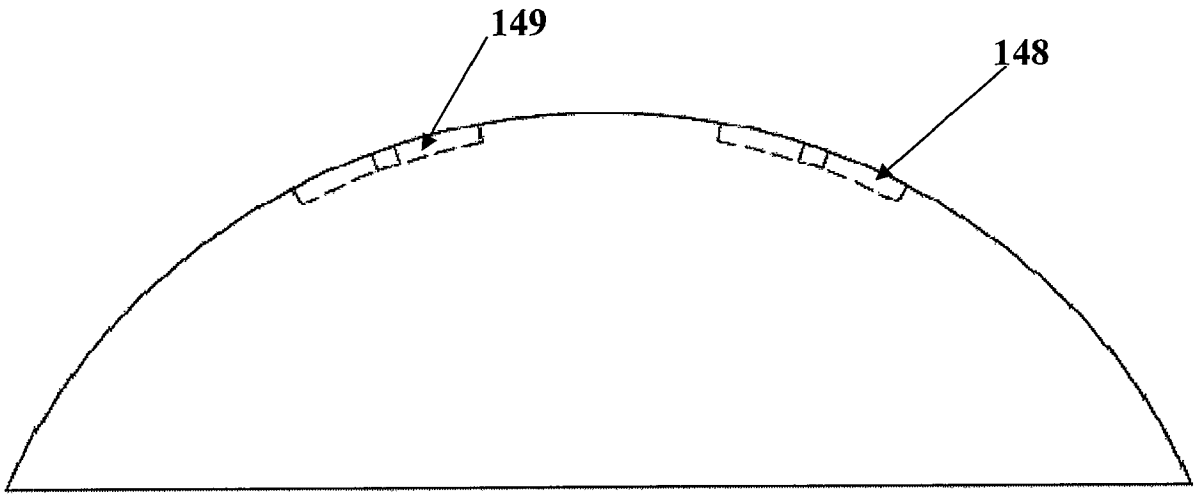
Figure 4C:
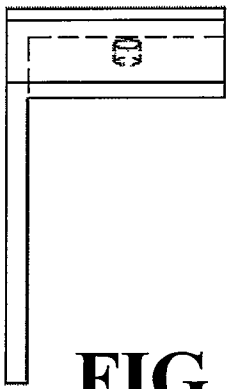

FIG. 4, which includes FIGS. 4*a*-4*c*, illustrates top (FIG. 4*a*), front (FIG. 4*b*), and side (FIG. 4*c*) elevation drawings of security tab 105. Right-side mounting tab 148 and left-side mounting tab 149 are illustrated in the top and front views of FIG. 4.

Figures 5A, 5B, 5C:
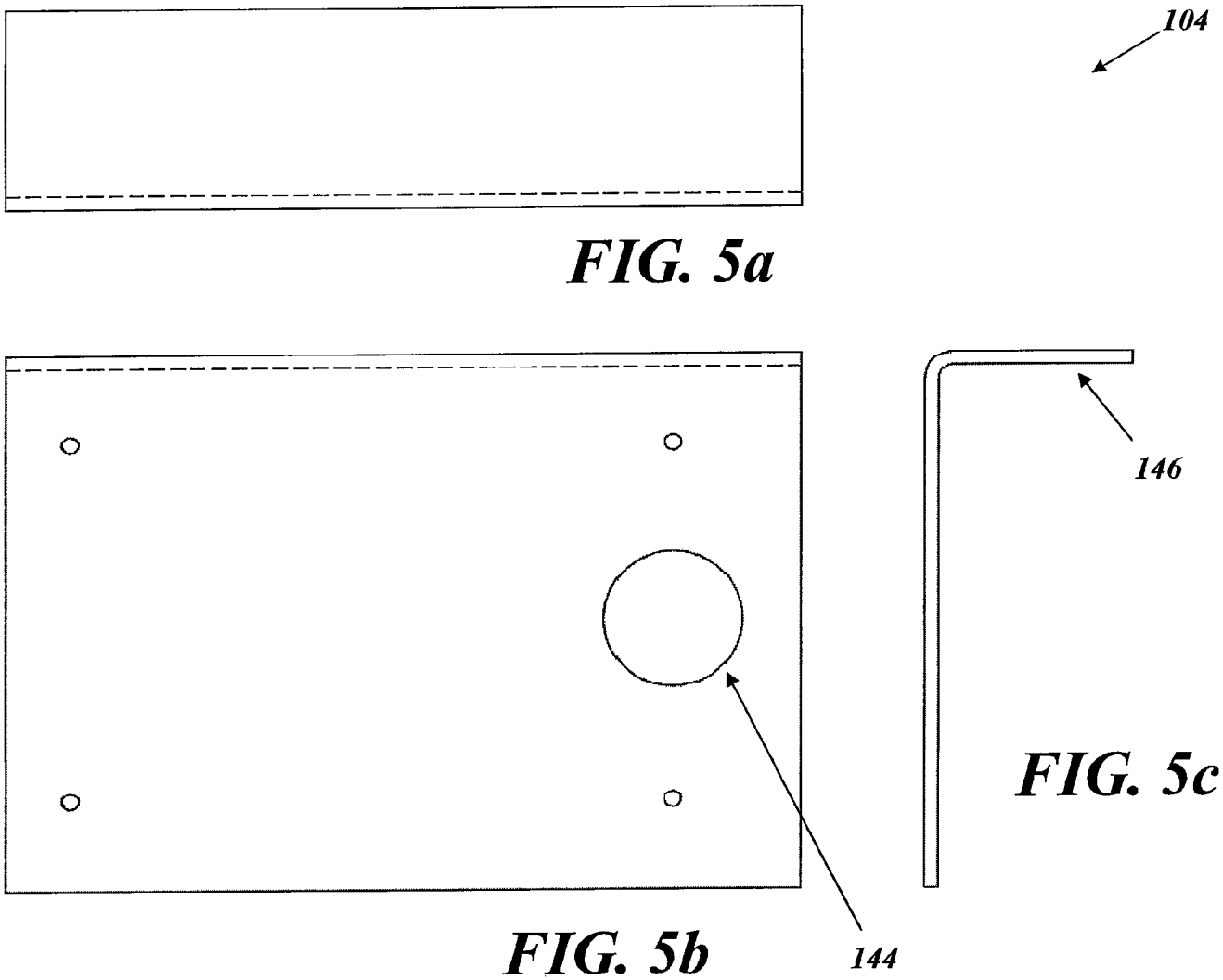
FIG. 5*a* illustrates a top elevation drawing, FIG. 5*b* a front elevation drawing, and FIG. 5*c* a side elevation drawing of a mailbox security door, constructed according to an embodiment.

FIG. 5, which includes FIGS. 5*a*-5*c*, illustrates top (FIG. 5*a*), front (FIG. 5*b*), and side (FIG. 5*c*) elevation drawings of security door 104. The extended horizontal surface 146 on the top edge of the security door 104 is visible in the side view in FIG. 5*c*.

Figure 6:
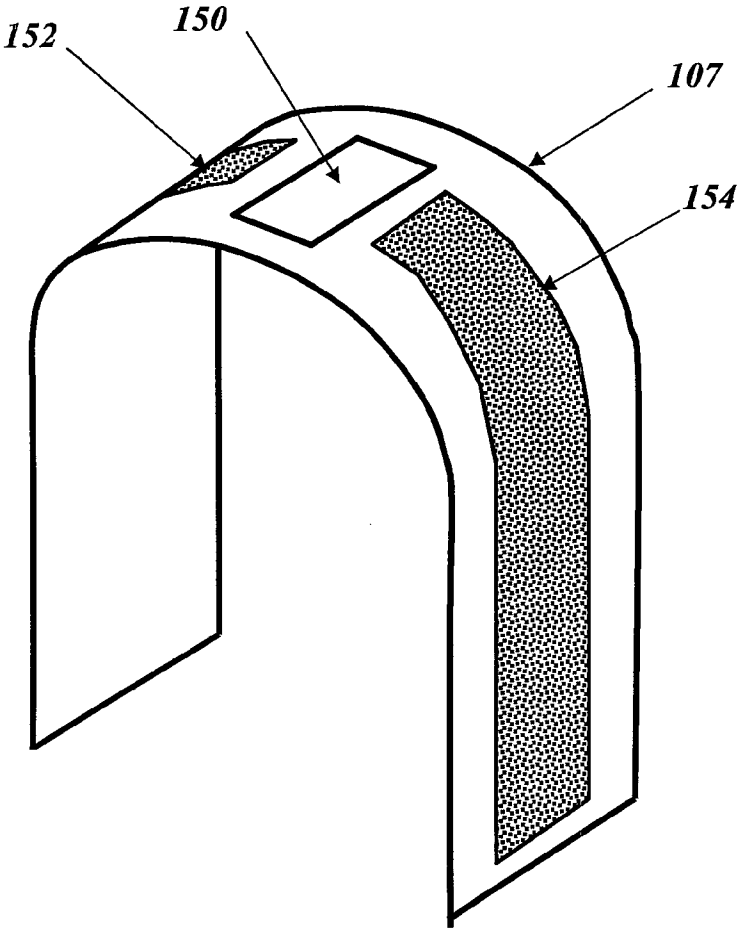
FIG. 6 illustrates a perspective drawing of a binding strap formed with a clearance aperture in a central portion of the binding strap, illustrating application of adhesive or two-sided adhesive tape, constructed according to an embodiment.

Turning now to FIG. 6, a perspective drawing of the binding strap 107 is shown. In this particular embodiment, the binding strap 107 includes a clearance aperture 150 in a central portion of the binding strap. The binding strap 107 may be secured to the interior surface of the mailbox with strips of two-sided adhesive tape, such as two-sided adhesive tape strips 152 and 154.

In practice, strips of a protective film (not shown) are ordinarily removably adhered to the adhesive surfaces of the two-sided adhesive tape 152/154, and are removed prior to adhering the strips of the two-sided adhesive tape 152/154 to an outer surface of the binding strap 107. The binding strap 107 with an exposed surface of the two-sided adhesive tape is then positioned near the interior surface of the mailbox 100, and the outer surface of the binding strap 107 is adhered to the interior surface of the mailbox housing 101 by pressing the binding strap 107 with the two-side adhesive tape 152/154 against the interior surface of the mailbox.

Figure 7:
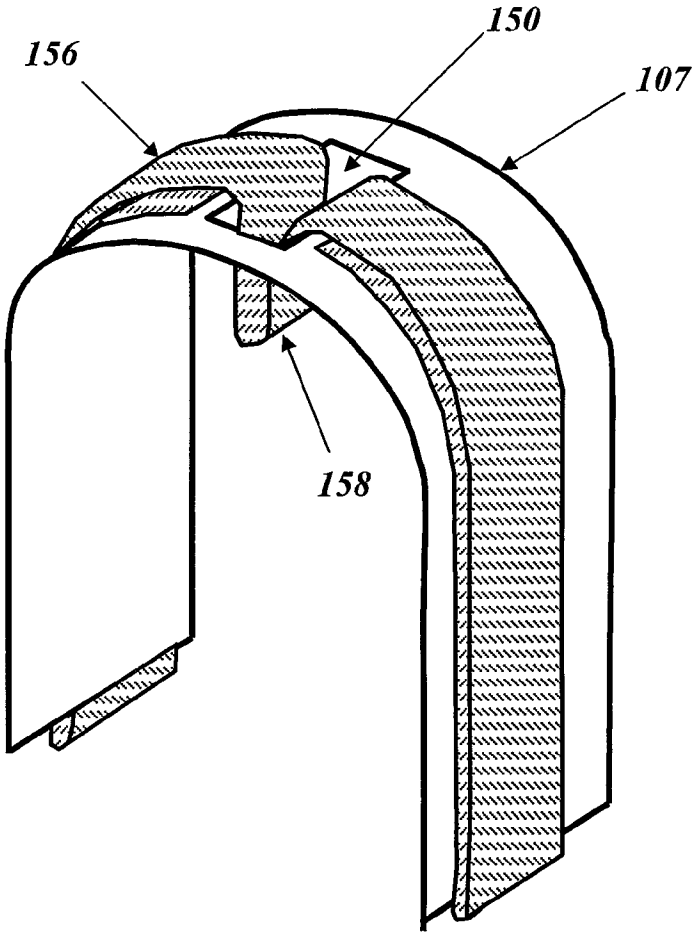
FIG. 7 illustrates a perspective drawing of a binding strap formed with a clearance aperture in its central portion, illustrating a protective film removably adhered to strips of two-sided adhesive tape, constructed according to an embodiment.

FIG. 7 provides a perspective drawing of the binding strap 107 formed with the clearance aperture 150 in its central portion, constructed according to an embodiment. A first surface of strips of two-side adhesive tape 152/154 (which cannot be seen in this view) are adhered to the outer surface of the binding strap 107, and a second surface of the strips of the two-sided adhesive tape are covered with a protective film 156 removably adhered to the second surface of the strips of the two-sided adhesive tape 152/154.

In this embodiment, a portion of the protective film 156 is led through and accessible through the clearance aperture 150 in the binding strap 107. In this case, a loop 158 is exposed from the bottom end of the binding strap 107. The protective film 156 is removed through the clearance aperture 150 in the binding strap by pulling on the exposed portions 158 of the protective film 156 that is in the interior of the mailbox housing 101. As the protective film 156 is withdrawn through the clearance aperture 150, the binding strap 107 with the exposed two-side adhesive tape 152/154 is pressed against the interior surface of the mailbox housing 101 to enable the binding strap 107 to be adhered to the interior surface of the mailbox housing 101.

Thus, a mailbox security kit has been described that may be employed for a retrofit arrangement to limit unauthorized access to delivered mail.

Although processes to form a retrofit arrangement to limit unauthorized access to delivered mail and related methods have been described for application in a retrofit mailbox environment, it should be understood that other applications of these processes such as for initial manufacture of a mailbox are contemplated within the broad scope of the invention, and need not be limited to retrofit applications employing processes introduced herein.

Although the invention has been shown and described primarily in connection with specific exemplary embodiments, it should be understood by those skilled in the art that diverse changes in the configuration and the details thereof can be made without departing from the essence and scope of the invention as defined by the claims below. The scope of the invention is therefore determined by the appended claims, and the intention is for all alterations that lie within the range of the meaning and the range of equivalence of the claims to be encompassed by the claims.

What is claimed is:

1. A mailbox security kit, comprising:

a binding strap conformable to an interior surface of a mailbox;

a security door hingeably attached to an inner surface of the binding strap;

a security tab rigidly attached to the inner surface of the binding strap;

a lock assembly coupled to the security door, wherein the lock assembly in a locked position is configured to restrain the security door in a closed position; and a lock strike attached to the inner surface of the binding strap, wherein the lock strike in conjunction with the lock assembly are configured to restrain the security door in the closed position.

2. The mailbox security kit as claimed in claim 1, wherein the security door in the closed position and the security tab form a mail insertion aperture between the security tab and the security door extending substantially a width of the mailbox reduced on a left side and a right side by a thickness of the binding strap, the aperture having a height in a range of about one inch to two inches.

3. The mailbox security kit as claimed in claim 1, wherein the security door includes a rearward extending horizontal surface on a top edge thereof.

4. The mailbox security kit as claimed in claim 1, wherein at least one of the security door and the security tab comprises chlorinated polyvinyl chloride.

5. The mailbox security kit as claimed in claim 1, further comprising:

a two-sided adhesive tape with a first surface adhered to an outer surface of the binding strap; and a protective film removably adhered to a second surface of the two-sided adhesive tape, wherein a portion of the protective film is accessible through a clearance aperture in the binding strap.

6. The mailbox security kit as claimed in claim 5, wherein the protective film is configured to be removed through the clearance aperture in the binding strap to enable the binding strap to be adhered to the interior surface of the mailbox.

7. A method of securing a mailbox, the method comprising:

providing a mailbox securing kit that includes a security door and a security tab that are attached to an inner surface of a binding strap;

locating the mailbox securing kit into the mailbox such that the binding strap substantially conforms to an interior surface of the mailbox; and attaching an outer surface of the binding strap to the interior surface of the mailbox such that the security tab and the security door provide secure lockable access to the mailbox;

wherein the security door in a closed position and the security tab form a mail insertion aperture between the security tab and the security door extending substantially a width of the mailbox, the aperture having a height in a range of about one inch to two inches.

8. The method as recited in claim 7, wherein the mailbox securing kit further comprises a locking mechanism that includes a lock assembly within the door and a lock strike attached to the inner surface of the binding strap, wherein the lock strike in conjunction with the lock assembly are configured to secure the security door in a closed position.

9. The method as recited in claim 7, wherein attaching the outer surface of the binding strap to the interior surface of the mailbox comprises adhering the binding strap to the mailbox using two-sided adhesive tape.

10. The method as recited in claim 9, wherein:

the mailbox securing kit further comprises the two-sided adhesive tape adhered to the outer surface of the binding strap and a protective film overlying the two-sided adhesive tape;

locating the mailbox securing kit into the mailbox comprises locating the protective film near the interior surface of the mailbox; and attaching the outer surface of the binding strap to the interior surface of the mailbox comprises removing the protective film and pressing the two-side adhesive tape against the interior surface of the mailbox.

11. The method as recited in claim 10, wherein:

the binding strap includes a clearance aperture near a center portion thereof;

the two-sided adhesive tape includes a first portion and a second portion separated from the first portion by the clearance aperture;

the protective film is accessible through the clearance aperture in the binding strap; and removing the protective film comprises pulling the protective film through the clearance aperture.

12. The method as recited in claim 7, wherein attaching the outer surface of the binding strap to the interior surface of the mailbox comprises adhering the binding strap to the mailbox using glue.

13. The method as recited in claim 7, wherein attaching the outer surface of the binding strap to the interior surface of the mailbox comprises adhering the binding strap to the mailbox using rivets.

14. A mailbox, comprising:

a mailbox housing;

a security door hingeably attached to a first interior side surface of the mailbox housing, the security door having a main face perpendicular to the interior side surface such that the security door swings out of the mailbox housing in an open position;

a lock assembly coupled to the security door;

a lock strike attached to a second interior side surface of the mailbox housing, wherein the lock strike in conjunction with the lock assembly are configured to restrain the security door in a closed position; and a security tab rigidly attached to an interior top surface of the mailbox housing, the security tab spaced from the security door by a slot when the security door is in the closed position, the slot having a width that is substantially the same as the width of the mailbox housing and a length of between about one and two inches.

15. The mailbox as claimed in claim 14, further comprising a binding strap rigidly attached to an interior surface of the mailbox, wherein the security door, the lock strike and the security tab are attached to the interior surface of the mailbox housing by the binding strap.

16. The mailbox as claimed in claim 15, wherein the binding strap is rigidly attached to the interior surface of the mailbox with pop rivets.

17. The mailbox as claimed in claim 15, wherein the binding strap is rigidly attached to the interior surface of the mailbox with two-sided adhesive tape.

18. The mailbox as claimed in claim 14, wherein the security door includes an extended horizontal surface on a top edge thereof, the extended horizontal surface extending between about one inch and two inches into the mailbox housing when the security door is in the closed position.

* * * * *

UNITED STATES PATENT AND TRADEMARK OFFICE

CERTIFICATE OF CORRECTION

PATENT NO. : 7,931,189 B2
APPLICATION NO. : 12/579160
DATED : April 26, 2011
INVENTOR(S) : Kalenberg It is certified that error appears in the above-identified patent and that said Letters Patent is hereby corrected as shown below:

On the Title Page, Section (76) Inventor, delete "Kalenburg" and insert --Kalenberg--.

Signed and Sealed this
Twenty-sixth Day of July, 2011

David J. Kappos
*Director of the United States Patent and Trademark Office*